US008891992B2

(12) United States Patent
Arakawa

(10) Patent No.: US 8,891,992 B2
(45) Date of Patent: Nov. 18, 2014

(54) IMAGE FORMING APPARATUS AND TEMPERATURE CONTROLLING METHOD OF IMAGE FORMING APPARATUS

(75) Inventor: Osamu Arakawa, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 331 days.

(21) Appl. No.: 13/444,891

(22) Filed: Apr. 12, 2012

(65) Prior Publication Data

US 2012/0294640 A1 Nov. 22, 2012

(30) Foreign Application Priority Data

May 20, 2011 (JP) ..... 2011-113096

(51) Int. Cl.
*G03G 15/20* (2006.01)

(52) U.S. Cl.
USPC ..... 399/70

(58) Field of Classification Search
CPC ..... G03G 15/205; G03G 15/2078
USPC ..... 399/69, 70, 323, 330, 335; 219/216
See application file for complete search history.

(56) References Cited

U.S. PATENT DOCUMENTS 5,109,255 A * 4/1992 Nishikawa et al. ..... 399/70
5,412,453 A * 5/1995 Matsuo ..... 399/33
8,150,290 B2 * 4/2012 Demuren et al. ..... 399/70
2005/0175367 A1 * 8/2005 Urabe ..... 399/69
2009/0310998 A1 * 12/2009 Otsuka ..... 399/70

FOREIGN PATENT DOCUMENTS

JP 07005790 A * 1/1995
JP 07028356 A * 1/1995
JP 07-114286 A 5/1995
JP 07-129021 A 5/1995
JP 07-140835 A 6/1995
JP 08166740 A * 6/1996
JP 2002304090 A * 10/2002
JP 2004226778 A * 8/2004

* cited by examiner

*Primary Examiner* — Robert Beatty
(74) *Attorney, Agent, or Firm* — Keating & Bennett, LLP

(57) ABSTRACT

An image forming apparatus includes a fusing unit with a heating member arranged to fuse toner to a printing paper, a heat source arranged to heat the heating member, a thermal sensor arranged to measure a surface temperature of the heating member, an electricity controlling unit arranged to control electricity supplied to the heat source based on a temperature measured by the thermal sensor, a first temperature controlling unit arranged to control the surface temperature of the heating member in STANDBY mode to gradually rise to an upper limit temperature by turning on/off electricity to the heat source with an electricity controlling unit, and a second temperature controlling unit arranged to control the surface temperature of the heating member in STANDBY mode to gradually fall to a lower limit temperature by turning on/off electricity to the heat source with the electricity controlling unit.

12 Claims, 3 Drawing Sheets

IMAGE FORMING APPARATUS AND TEMPERATURE CONTROLLING METHOD OF IMAGE FORMING APPARATUS

CROSS-REFERENCE TO RELATED APPLICATIONS

This application claims priority under 35 U.S.C. 119 to Japanese Patent Application No. 2011-113096, filed on May 20, 2011, which application is hereby incorporated by reference in its entirety.

BACKGROUND OF THE INVENTION

1. Field of the Invention

The present invention relates to an image forming apparatus, such as a copier, facsimile or printer including a fusing unit to fuse toner to a printing paper, and provides an improved image forming apparatus with respect to temperature control in STANDBY mode of a heater.

2. Description of the Related Art

An image forming apparatus including STANDBY mode shifts an operation mode from PRINT mode to STANDBY mode when a predetermined period of time passes since a printing operation is finished. With the image forming apparatus, an upper limit temperature and a lower limit temperature in STANDBY mode are previously set with regard to a surface temperature of a heat roller. When the surface temperature reaches the upper limit temperature, the image forming apparatus stops supplying heat to the heat roller by turning off a heater, and also when the surface temperature reaches the lower limit temperature, the image forming apparatus resumes supplying heat to the heat roller by turning on the heater. However, this temperature control cannot prevent temperature overshoot in which the surface temperature of the heat roller exceeds the upper limit temperature and temperature undershoot in which the surface temperature of the heat roller falls below the lower limit temperature. In particular, where an image forming apparatus uses a heat roller with a lower thermal capacity due to a thin tube in order to shorten a warming-up time, temperature overshoot or undershoot is likely to occur.

In order to prevent the temperature overshoot or undershoot, the conventional image forming apparatus turns off the heater at a lower temperature than the upper limit temperature, provided that the surface temperature of the heat roller is rising. Likewise, conventional image forming apparatus turns on the heater at a higher temperature than the lower limit temperature, provided that the surface temperature of the heat roller is falling. In other words, the conventional image forming apparatus turns on/off the heater in the earlier stage of fusing so as to prevent the heat roller from causing temperature overshoot or undershoot.

Further, the conventional image forming apparatus gradually lowers the surface temperature of the heat roller. The conventional image forming apparatus lowers a surface temperature setting of the heat roller gradually every time a predetermined period of time, for example, 10 seconds, passes since the surface temperature thereof reaches a fusing temperature, and is configured so that power consumption by a heat source can be reduced while maintaining the surface temperature of the heat roller within a range of temperatures suitable for fusing. Furthermore, the temperature settings are gradually lowered according to a heat radiation rate of the heat roller.

According to the conventional image forming apparatus, temperature overshoot or undershoot can be avoided to some extent by turning on/off a heater at the early stage. In this method, however, only a difference between a transitory value of a roller temperature and a target temperature becomes smaller, which cannot completely prevent temperature overshoot or undershoot.

According to the conventional image forming apparatus, unless the surface temperature of the heat roller falls to a lower fusing limit temperature after the surface temperature of the heat roller reaches the fusing temperature, power consumption by a heat source can be reduced by gradually lowering the temperature setting. However, because the difference between the fusing upper limit temperature and the fusing lower limit temperature is subtle, the image forming apparatus reduces only a small amount of power, which provides less contribution to power saving.

Although a higher temperature in STANDBY mode smoothly shifts an operation mode to PRINT mode, an increase in power consumption by a heat source is inevitable. Further, although a greater difference between the upper limit temperature and the lower limit temperature in STANDBY mode can reduce power consumption by the heat source, shifting to PRINT mode may require more time. By setting a standby temperature at an intermediate temperature between the upper limit temperature and the lower limit temperature in STANDBY mode, the time taken to shift the operation mode to PRINT mode can be shortened while power consumption by the heat source is reduced to some extent. However, in this case, stuffy heat in the surrounding area of the fusing unit is inevitable, and even in STANDBY mode, the stuffy heat needs to be expelled from a case by driving a cooling fan, which inevitably increases power consumption.

SUMMARY OF THE INVENTION

In order to overcome the problems described above, preferred embodiments of the present invention provide an image forming apparatus that can maintain a surface temperature of a heat roller within a range of setting temperatures without causing temperature overshoot or undershoot and that can also smoothly shift an operating mode to PRINT mode.

According to a preferred embodiment of the present invention, an image forming apparatus includes a fusing unit including a heating member arranged to fuse toner to a printing paper, a heat source arranged to heat the heating member, a thermal sensor arranged to measure a surface temperature of the heating member, an electricity controlling unit arranged to control electricity to the heat source based on a temperature measured by the thermal sensor, a first temperature controlling unit arranged to control the surface temperature of the heating member in STANDBY mode to gradually rise to reach an upper limit temperature by repeatedly turning on/off electricity to the heat source with the electricity controlling unit, and a second temperature controlling unit arranged to control the surface temperature of the heating member in STANDBY mode to gradually fall to reach a lower limit temperature by repeatedly turning on/off electricity to the heat source with the electricity controlling unit.

The image forming apparatus in accordance with a preferred embodiment of the present invention gradually raises or lowers the surface temperature of the heating member in STANDBY mode by repeatedly turning on/off electricity to the heat source in each process where the temperature of the heating member is rising and falling. Compared to the conventional temperature control, repeatedly turning on/off electricity to the heat source as described so far leads to gradual changes in temperatures when the temperature is rising or lowering. Further, the image forming apparatus in accordance with a preferred embodiment of the present invention can gradually raise the surface temperature of the heating member to reach the upper limit temperature with repeated slight rise and fall in the surface temperature, and can gradually lower the surface temperature of the heating member to reach the lower limit temperature with the repeated slight rise and fall in the surface temperature. The image forming apparatus in accordance with a preferred embodiment of the present invention can also turn on/off electricity to the heat source and shorten time lag in the surface temperatures of the heating member. Thus, the surface temperature of the heating member can be maintained in STANDBY mode within a range from the upper limit temperature to the lower limit temperatures without causing temperature overshoot or undershoot.

Further, the image forming apparatus in accordance with a preferred embodiment of the present invention shortens the time required to shift an operation mode from STANDBY mode to PRINT mode since the surface temperature of the heating member is gradually raised or lowered with the repeated slight rise and fall in the surface temperature between the upper limit temperature and the lower limit temperature. This is because, compared to cases where electricity to the heat source is turned on/off when the surface temperature is close to the upper or the lower limit temperature, the surface temperature of the heating member is maintained at a higher level than an average surface temperature of the heating member.

According to a preferred embodiment of the present invention, the image forming apparatus includes a cooling fan arranged to expel ambient heat of the fusing unit from a case and a fan controlling unit arranged to rotate the cooling fan during a standby state at high temperature.

The image forming apparatus in accordance with a preferred embodiment of the present invention maintains the surface temperature of the heating member in the standby state at a high temperature between the upper limit temperature and a temperature slightly lower than the upper limit temperature. Therefore, the heat dissipated from the heating member is likely to remain in the case, which may deteriorate plastic components or cause heat deformation. In another preferred embodiment of the present invention, the image forming apparatus is configured to be capable of rotating a cooling fan in the standby state at high temperature so that the heat remaining inside the case is expelled therefrom, which prevents deterioration of plastic components and heat deformation.

With the image forming apparatus in accordance with a preferred embodiment of the present invention, the fan controlling unit controls a rotation frequency of the cooling fan in the standby state at high temperature to be less than the one in a process of fusing.

The image forming apparatus in accordance with a preferred embodiment of the present invention controls the rotation frequency of the cooling fan in the standby state at high temperature to be less than the one in the process of fusing. This setting ensures that deterioration of internal plastic components or heat deformation in the standby state at high-temperature is avoided, which lowers power consumption in STANDBY mode and suppresses noise produced by the cooling fan.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
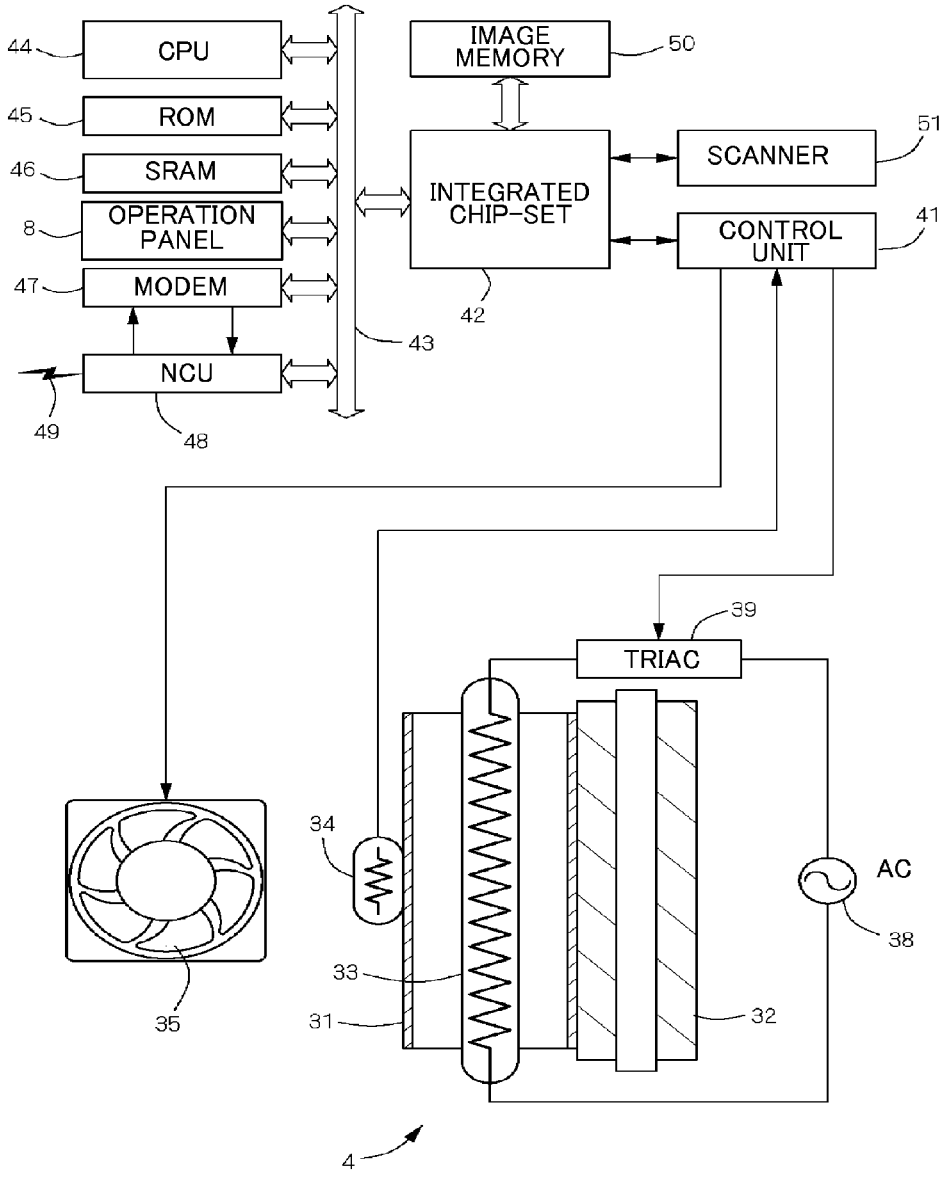
FIG. 1 is a schematic view and a block diagram of an image forming apparatus in accordance with a preferred embodiment of the present invention.
Figure 2:
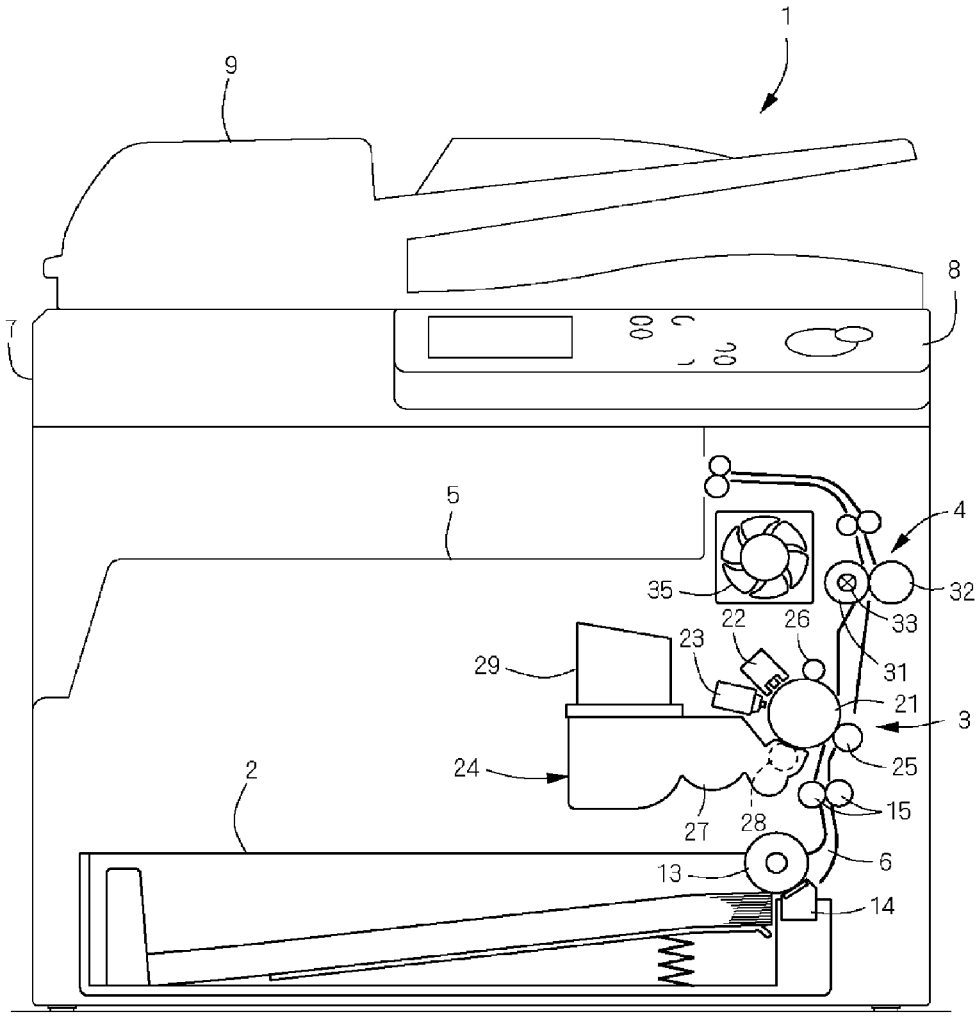
FIG. 2 is a schematic longitudinal sectional view of the image forming apparatus.
Figure 3:
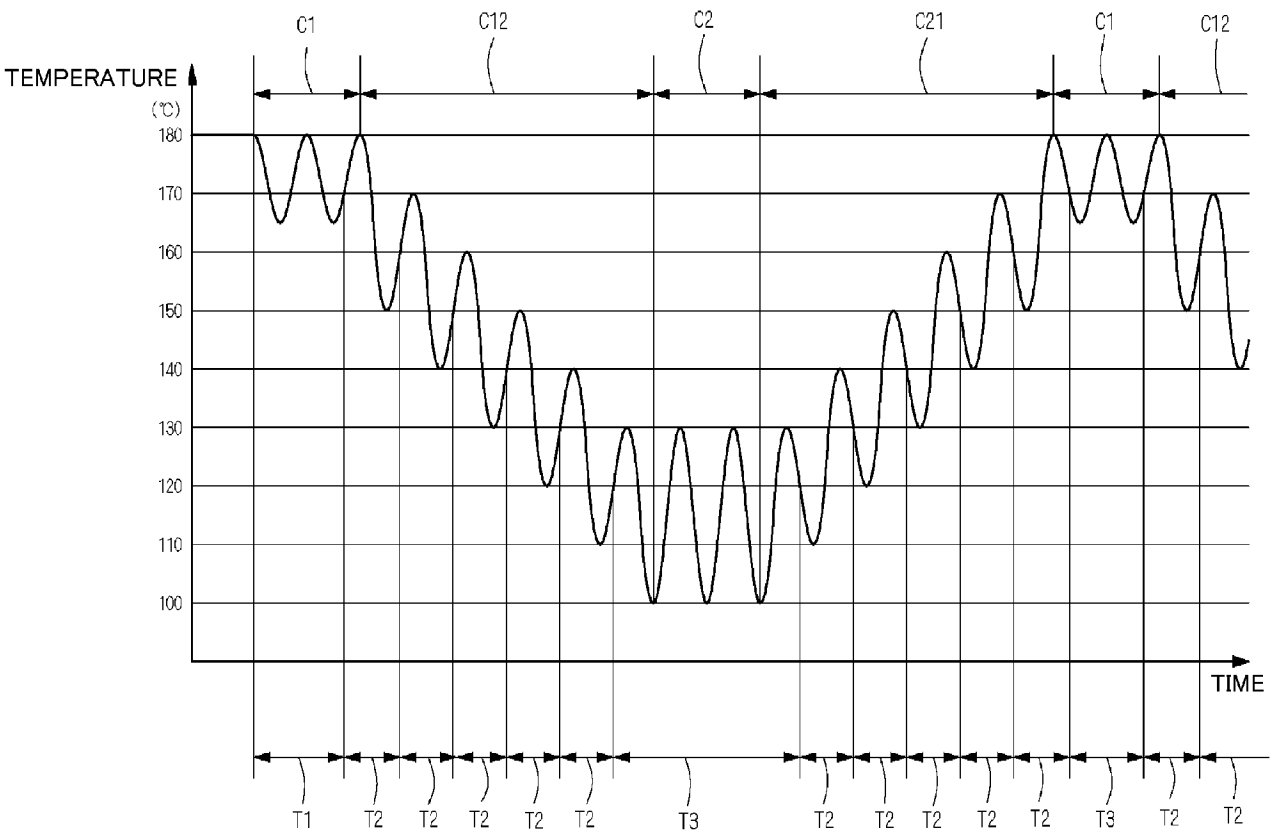
FIG. 3 is a graph indicating thermal changes of a heating member of a fusing unit in STANDBY mode.

FIGS. 1 to 3 illustrate a multifunctional peripheral including copier and facsimile functions as an image forming apparatus in accordance with a preferred embodiment of the present invention. The multifunctional peripheral 1 in FIG. 2 is provided with a paper feeding cassette 2 arranged to store printing papers, an image forming section 3 arranged to form a toner image to the printing paper fed from the paper feeding cassette 2, and a fusing unit 4 arranged to fuse the toner image to the printing paper with heat and pressure. Inside the multifunctional peripheral 1, a paper feeding path 6 leading from the paper feeding cassette 2 through an image forming unit 3 and the fusing unit 4 to a paper exit tray 5 is provided. An image scanning unit 7 is arranged above the paper exit tray 5, and an operation panel 8 including operation buttons is arranged in front of the image scanning section 7. An automatic document feeder 9 is provided above the image scanning section 7.

The paper feeding cassette 2 is provided with a pick-up roller 13 arranged to feed a printing paper to the paper feeding path 6, and a friction pad 14 arranged to prevent multi-feeding of printing papers by making close contact with the pick-up roller 13. Between the pick-up roller 13 and the image forming section 3 provided on the paper feeding path 6, a pair of registration rollers 15 that control the timing of feeding a printing paper to the image forming section 3 is provided so that the printing paper is synchronized with a toner image on a photosensitive drum 21, which is described later.

The image forming section 3 is configured so that the photosensitive drum 21 is provided at the center thereof, and the photosensitive drum 21 rotates counterclockwise in FIG. 2 in an image forming process. In a peripheral area of the photosensitive drum. 21, a corona charger 22, a light-emitting diode (LED) print head 23, a developing unit 24, a transfer roller 24, and a cleaner 23 are arranged in this order in the rotation direction thereof. The LED print head 23 forms an electrostatic latent image by exposing a surface of the photosensitive drum 21 charged with the corona charger 22. The developing unit 24 includes a housing 27 to contain non-magnetic single component developer and a developing roller 28 arranged at an opening portion of the housing 27 and supplies toner on the surface of the photosensitive drum 21 through the developing roller 28. The transfer roller 25 transfers a toner image formed on the surface of the photosensitive drum 21 to a printing paper. The cleaner 26 removes the electric charge and remaining toner on the surface of the photosensitive drum 21. A toner cartridge 29 that supplies toner to the housing 27 is provided on the housing 27.

As illustrated in FIG. 1, the fusing unit 4 preferably includes a heat roller (heating member) 31 and a pressure roller 32 which define a nipping portion to heat and press a printing paper, and a heater (heat source) 33 to heat the heat roller 31, or other suitable element. The heat roller 31 is preferably made of metal such as aluminum having higher thermal conductivity, and preferably has a cylindrical shape.

Elastic body layers made of silicon rubber or the like are provided on an outer circumferential surface of the pressure roller 32 of the rotation axis parallel to the center axis of the heat roller 31, and the pressure roller 32 is pressed to the heat roller 31 with an elastic body (not illustrated). The heater 33 preferably includes a halogen lamp and is arranged with the whole portion of the heat roller 31 being inserted into the heater 33 in the axis direction. The heater 33 is incorporated into a circuit having an alternating-current (AC) power source 38 and a triode for alternating current (TRIAC) 39.

A thermal sensor 34 including a thermistor is arranged to be in close contact with the outer circumferential surface of the heat roller 31 at the center in the axis direction. A surface temperature measured by the thermal sensor 34 is transmitted to a control unit 41, which will be described later, to be used to control temperatures of the heater 33. A reference numeral 35 indicates a cooling fan to expel ambient heat of the fusing unit 4 from the case. The cooling fan 35 is activated mainly in a process of fusing.

A control unit 41 that controls operations of the multifunctional peripheral 1 is connected to a central processing unit (CPU) 44 via an integrated chip-set 42 and a system bus 43. The CPU 44 executes various arithmetic processing based on a program stored in a read only memory (ROM) 45. Further, the ROM 45 stores information on temperatures, such as fusing and pick-up temperatures which will be described later, or upper/lower limit temperatures, and information on time, such as duration in STANDBY mode. A static random access memory (SRAM) 46 is used as work space for arithmetic processing with the CPU 44.

The system bus 43 is connected with an operation panel 8, a modem 47 and a network control unit (NCU) 48. The modem 47 is configured as a facsimile modem capable of performing facsimile communication, and modulates transmitted data and demodulates received data. The NCU 48 establishes/breaks connection between the modem 47 and a public switched telephone network (PSTN) 49. An image memory 50, preferably a synchronous random access memory (SDRAM) or other suitable memory, is connected to the integrated chip-set 42. The image memory 50 temporarily stores image data scanned with a scanner 51 configuring an image scanning unit 7 and image data received through facsimile communication, and other data.

In PRINT mode, by controlling the TRIAC 39, the control unit 41 turns on/off electricity from the AC power source 38 to the heater 33 in order to maintain the surface temperature of the heat roller 31 (hereinafter referred to as "roller temperature"), which is measured by the thermal sensor 34, to be a fusing temperature of toner (for example, 180° C.) or higher. When a printing job is finished, the control unit 41 shifts an operation mode to STANDBY mode. Meanwhile, in STANDBY mode, the control unit 41 maintains the roller temperature at a temperature between the upper limit temperature, which is equal to or higher than the fusing temperature, and the lower limit temperature, which is lower than the upper limit temperature, by turning on/off electricity to the heat source 33. The control unit 41 sets the upper limit temperatures to, for example, 180° C. equivalent to the fusing temperature and the lower limit temperature to, for example, 100° C.

More specifically, in STANDBY mode, the control unit 41 sets temperatures to deactivate the heater 33 (off-temperature) and to activate the heater 33 (on-temperature) within the range from the upper limit temperature to the lower limit temperature. The on-temperature and the off-temperature are variables which vary as time goes by. When the roller temperature is getting closet to the off-temperature, the control unit 41 turns off electricity to the heater 33 by turning off the TRIAC 39, and when the roller temperature is getting close to the on-temperature, the control unit 41 turns on electricity to the heater 33 by turning on the TRIAC 39. A duty cycle of the heater 33 is set to 50 percent in STANDBY mode, and by controlling the TRIAC 39, one half wave of an AC voltage from the AC power source is supplied to the heater 33. In the process of fusing, a full wave of an AC voltage from the AC power source 38 is supplied to the heater 33.

As indicated in FIG. 3, in STANDBY mode, the control unit 41 controls the TRIAC 39 so that the roller temperature repeatedly changes among a standby state at high-temperature C1, a temperature-falling state C12, a standby state at low temperature C2 and a temperature-rising state C21 in turn. In the standby state at high temperature C1, the roller temperature is maintained at a temperature between the upper limit temperature (180° C.) and a temperature (165° C.) slightly lower than the upper limit temperature. In the temperature-falling state C12, the roller temperature gradually falls to the lower limit temperature (100° C.) with repeated rise and fall in the roller temperature. In the standby state at low temperature C2, the roller temperature is maintained between the lower limit temperature and a temperature (130° C.) slightly higher than the lower limit temperature. In the temperature-rising state C21, the roller temperature gradually rises to the upper limit temperature with repeated rise and fall in the roller temperature.

After a printing job is finished and operation mode is shifted to STANDBY mode, the roller temperature immediately turns out the standby state at high temperature state C1, and then the on-temperature and the off-temperature are set to, for example, 180° C. and 165° C., respectively. When the roller temperature falls and is getting close to the on-temperature (for example, 165° C.), the control unit 41 activates the heater 33. Meanwhile, when the roller temperature rises and is getting close to the off-temperature (for example, 180° C.), the control unit 41 deactivates the heater 33. In this way, the roller temperature repeatedly rises and falls within the range from, for example, 165° C. and 180° C. Note that in the standby state at high temperature C1, the cooling fan 35 is activated so as to expel ambient heat of the fusing unit 4 from the case. At this time, the rotation frequency of the cooling fan 35 is set to approximately half the rotation frequency in the process of fusing. The control unit 41 deactivates the cooling fan 35 while the roller temperature is in the temperature-falling state C12, the standby state at low temperature C2, and the temperature-rising state C21.

After a first predetermined period of time T1 (for example, 60 seconds) passes since the shift to the standby state at high temperature C1, the control unit 41 changes a setting of the on-temperature to, for example, 150° C. while maintaining the off-temperature at, for example, 180° C. Then, once the roller temperature reaches, for example, 180° C., the control unit 41 controls the roller temperature to shift the temperature state from the standby state at high temperature C1 to the temperature-falling state C12. Further, after a second predetermined period of time T2 (for example, 30 seconds) passes since the on-temperature is lowered, the control unit 41 changes the settings of the on-temperature and the off-temperature by, for example, 10 degrees respectively to, for example, 170° C. and 140° C. After that, in the temperature-falling state C12, the control unit 41 lowers each of the off-temperature and the on-temperature by, for example, 10 degrees every time the second predetermined period time T2 passes.

As indicated in FIG. 3, in the temperature-falling state C12, the roller temperature shifts from rising to falling, and then the roller temperature starts rising again at each time slot of the second predetermined period of time T2. More specifically, at the time when the control unit 41 sets the off-temperature and the on-temperature to, for example, 170° C. and 140° C. respectively, the roller temperature is, for example, 160° C., which is in a state of rising. After this setting, once the roller temperature rises to, for example, 170° C., it starts falling. A little while later, when the roller temperature lowers to, for example, 140° C., it resumes rising. When the second predetermined period of time T2 passes after the previous setting, the control unit 41 changes the settings of the off-temperature and the on-temperature to, for example, 160° C. and 130° C., respectively. At this time, the roller temperature is, for example, 150° C., which is in a state of rising.

At the last stage of the temperature-falling state C12, the control unit 41 sets the off-temperature and the on-temperature to, for example, 130° C. and 100° C., respectively. Then, when the roller temperature falls to, for example, 100° C., the control unit 41 shifts the temperature state to the standby state at low temperature C2. In the standby state at low temperature C2, the roller temperature repeatedly rises and falls within the range from, for example, 100° C. to 130° C.

After a third predetermined period of time T3 (for example, 60 seconds) passes since the off-temperature and the on-temperature are set to, for example, 130° C. and 100° C., respectively, the control unit 41 raises each of the off-temperature and the on-temperature by 10 degrees to, for example, 140° C. and 110° C. After that, in the temperature-rising state C21, every time the second predetermined period of time passes, the control unit 41 raises each of the off-temperature and the on-temperature by, for example, 10 degrees. That is, the control unit 41 performs a reverse control as in the previous temperature-falling state C12. In the temperature-falling state C12, at each time slot of the second predetermined period of time T2, the roller temperature is shifted from falling to rising, and then it starts falling again. At the last stage of the temperature-falling state C21, the control unit 41 changes each of the settings of the off-temperature and the on-temperature to, for example, 180° C. and 150° C. respectively. Then, when the roller temperature rises to, for example, 180° C., the control unit 41 shifts the temperature state to the standby state at high temperature C1 again. After that, the state of the roller temperature repeatedly changes among the standby state at high temperature C1, the temperature-falling state C12, the standby state at low temperature C2, and the temperature-rising state C21 in turn.

As described above, in the standby state at high temperature C1, the roller temperature is maintained at a temperature between the upper limit temperature (for example, 180° C.) and a temperature close to the upper limit temperature (for example, 165° C.). Therefore, where an instruction to print is given in the standby state at high temperature C1, the roller temperature is immediately raised to a paper-feeding temperature by turning on electricity to the heater 33 even if the roller temperature has reached or has not reached to the paper-feeding temperature (for example, 170° C.) at this time. Thus, the multifunctional peripheral 1 can immediately start executing the printing job.

Meanwhile, in the standby state at low temperature C2, the control unit 41 maintains the roller temperature at a temperature between, for example, 100° C. and 130° C. In the standby state at low temperature C2, the total power consumed by the heater 33 in STANDBY mode can be reduced. Further, by maintaining the roller temperature at a temperature between, for example, 100° C. and 130° C., internal components whose temperatures have heated up in the standby state at high temperature C1 are cooled down, which prevents thermal damage to the components. As the temperature inside the case can be lowered without activating the cooling fan 35, the total power consumed by the multifunctional peripheral 1 also reduces and operation noises can be suppressed.

Further, the multifunctional peripheral 1 in accordance with a preferred embodiment of the present invention is configured to be capable of gradually raising or lowering the roller temperature by repeatedly activating/deactivating the heater 33. Compared to the conventional temperature control, repeatedly turning on/off electricity to the heater 33 as described above allows the roller to gradually change its temperature in the temperature rising state C21 and the temperature-falling state C12. The control unit 41 gradually raises/lowers the roller temperature to reach the upper and the lower limit temperatures with repeated slight rise and fall in the roller temperature. The control unit 41 can also turn on/off the heater 33, and shorten the time lag in the roller temperatures. Accordingly, in STANDBY mode, the roller temperature can be maintained within the range from the upper limit temperature and the lower limit temperature without temperature overshoot or undershoot.

As the roller temperature is changed slightly with the repeated rise and fall in the roller temperature between the upper limit temperature and the lower limit temperature, the time taken to shift an operation mode of the multifunctional peripheral 1 from STANDBY mode to PRINT mode is significantly reduced. This is because the roller temperature is maintained higher than an average surface temperature of the heat roller 31 compared to the cases where the heater is turned on/off at a temperature close to the upper limit temperature or the lower limit temperature.

In the above-described preferred embodiment of the present invention, an operation mode of the multifunctional peripheral 1 may preferably be shifted to STANDBY mode immediately after a printing operation is finished. However, the operation mode may be shifted to STANDBY mode after a give period of time passes since a printing job is finished. In this case, the control unit 41, for example, maintains the roller temperature at the fusing temperature (for example, 180° C.) until the operation mode is shifted to STANDBY mode, and the upper limit temperature is set equal to or lower than the fusing temperature. In STANDBY mode, the rotation frequency of the cooling fan 35 and a period of time in which the cooling fan 35 is activated may be arbitrarily set. For example, the image processing apparatus may be configured so that the control unit 41 activates the cooling fan 35 only when the temperature inside the case exceeds a threshold value.

The duty cycle of the heater 33 in STANDBY mode does not need to be 50 percent, the duty cycle may be arbitrarily set. However, taking the balance between a rising speed of the roller temperature and power consumption into consideration, it is favorable to set the duty cycle between about 30 and about 50 percent, for example. As a switching element of the heater 33 may not be a TRIAC 39, any element may be used. The heating member 31 may not be a roller, and therefore, a belt wound around a roller, for example, may be adopted. Further, instead of the heat roller 32, a belt wound around a roller or the like may be adopted. The heat source 33 may not be a bar-shaped heater, a rolled flexible heating sheet may be adopted.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An image forming apparatus comprising:

a fusing unit including a heating member arranged to fuse toner to a printing paper;

a heat source arranged to heat the heating member;

a thermal sensor arranged to measure a surface temperature of the heating member;

an electricity controlling unit arranged to control electricity supplied to the heat source based on a temperature measured by the thermal sensor;

a first temperature controlling unit arranged to control the surface temperature of the heating member in STANDBY mode to rise to an upper limit temperature by repeatedly turning on/off electricity supplied to the heat source with the electricity controlling unit; and a second temperature controlling unit arranged to control the surface temperature of the heating member in STANDBY mode to fall to a lower limit temperature by repeatedly turning on/off electricity supplied to the heat source with the electricity controlling unit.

2. The image forming apparatus according to claim 1, further comprising:

a third temperature controlling unit arranged to maintain the surface temperature of the heating member in between a temperature-rising state and a temperature-falling state at a temperature between the upper limit temperature and a temperature lower than the upper limit temperature by turning on/off electricity supplied to the heat source with the electricity controlling unit.

3. The image forming apparatus according to claim 2, further comprising:

a cooling fan arranged to expel ambient heat of the fusing unit from a case, and a fan controlling unit arranged to rotate the cooling fan in a standby state at a predetermined temperature.

4. The image forming apparatus according to claim 3, wherein the fan controlling unit controls a rotation frequency of the cooling fan in the standby state at the predetermined temperature to be less than that during a process of fusing.

5. The image forming apparatus according to claim 1, further comprising:

a fourth temperature controlling unit arranged to maintain the surface temperature of the heating member in between a temperature-falling state and a temperature-rising state at a temperature between the lower limit temperature and a temperature higher than the lower limit temperature by turning on/off electricity supplied to the heat source with the electricity controlling unit.

6. The image forming apparatus comprising:

means for fusing toner to a printing paper using a heating member;

means for heating the heating member using a heat source;

means for measuring a surface temperature of the heating member;

means for controlling electricity supplied to the heat source based on a temperature measured by the means for measuring;

means for controlling the surface temperature of the heating member so as to rise to reach an upper limit temperature in STANDBY mode by repeatedly turning on/off electricity supplied to the heat source; and means for controlling the surface temperature of the heating member so as to fall to reach a lower limit temperature in STANDBY mode by repeatedly turning on/off electricity supplied to the heat source.

7. The image forming apparatus according to claim 6, further comprising:

means for maintaining the surface temperature of the heating member in between a temperature-rising state and a temperature-falling state at a temperature between the upper limit temperature and a temperature lower than the upper limit temperature by turning on/off electricity to the heat source.

8. The image forming apparatus according to claim 7, further comprising:

means for expelling ambient heat of the heating member from a case using a cooling fan; and means for controlling the cooling fan to rotate in a standby state at a predetermined temperature.

9. The image forming apparatus according to claim 8, further comprising means for controlling a rotation frequency of the cooling fan at the standby state at the predetermined temperature to be less than that during the process of fusing.

10. The image forming apparatus according to claim 6, further comprising:

means for maintaining the surface temperature of the heating member in between a temperature-falling state and a temperature-rising state at a temperature between the lower limit temperature and a temperature higher than the lower limit temperature by turning on/off electricity to the heat source.

11. A method for controlling temperatures of an image forming apparatus, comprising the steps of:

maintaining a surface temperature of a heating member at a temperature between an upper limit temperature and a temperature lower than the upper limit temperature by turning on/off electricity supplied to a heat source;

controlling the surface temperature of the heating member to fall to the lower limit temperature by repeatedly turning on/off the electricity supplied to the heat source;

maintaining the surface temperature of the heating member at a temperature between the lower limit temperature and a temperature higher than the lower limit temperature by turning on/off electricity supplied to the heat source; and controlling the surface temperature of the heating member to fall to the lower limit temperature by repeatedly turning on/off electricity supplied to the heat source.

12. The method for controlling temperatures of the image forming apparatus according to claim 11, further comprising the step of expelling ambient heat of the heating member from a case using a cooling fan.

* * * * *